United States Patent [19]

Reynolds

[11] Patent Number: 4,789,463

[45] Date of Patent: Dec. 6, 1988

[54] DEMETALATION OF HYDROCARBONACEOUS FEEDSTOCKS USING HYDROXO-CARBOXYLIC ACIDS AND SALTS THEREOF

[75] Inventor: John G. Reynolds, El Cerrito, Calif.

[73] Assignee: Chevron Research Company, San Francisco, Calif.

[21] Appl. No.: 901,343

[22] Filed: Aug. 28, 1986

[51] Int. Cl.[4] ..... C10G 17/00

[52] U.S. Cl. ..... 208/252; 208/251 R; 208/253; 585/833

[58] Field of Search ..... 208/251 R, 252, 253; 585/833

[56] References Cited

U.S. PATENT DOCUMENTS

| | | | |
|---|---|---|---|
| 2,767,123 | 10/1956 | Kickok et al. | 208/252 |
| 3,153,623 | 10/1964 | Elidib et al. | 208/251 R |
| 3,322,664 | 5/1967 | Paterson et al. | 208/48 |
| 3,449,243 | 6/1969 | Strong, Jr. et al. | 208/251 R |
| 4,280,897 | 7/1981 | Shah et al. | 208/113 |
| 4,431,524 | 2/1984 | Norman | 208/252 |
| 4,432,865 | 2/1984 | Norman | 208/252 |
| 4,439,345 | 3/1984 | Duke | 252/330 |
| 4,539,099 | 9/1985 | Merchant et al. | 208/251 R |
| 4,568,450 | 2/1986 | Ling et al. | 208/251 H |

FOREIGN PATENT DOCUMENTS

| | | | |
|---|---|---|---|
| 3300413 | 7/1983 | Fed. Rep. of Germany | 208/309 |

*Primary Examiner*—Carl F. Dees
*Assistant Examiner*—Helane Myers
*Attorney, Agent, or Firm*—S. R. La Paglia; T. G. DeJonghe; Q. T. Dickinson

[57] ABSTRACT

A process is disclosed for removing metals contaminants, particularly iron, and more particularly non-porphyrin, organically-bound iron compounds, from hydrocarbonaceous feedstock, particularly crude petroleum or residua. The process comprises mixing the feedstock with an aqueous solution of hydroxo-carboxylic acids or salts thereof, preferably citric acid, and separating the aqueous solution and metals from the demetalated feedstock.

13 Claims, No Drawings

DEMETALATION OF HYDROCARBONACEOUS FEEDSTOCKS USING HYDROXO-CARBOXYLIC ACIDS AND SALTS THEREOF

BACKGROUND OF THE INVENTION

This invention relates to a process for the removal of iron from iron-containing petroleum crudes, heavy hydrocarbonaceous residua or solvent deasphalted oils derived from crudes and residua, using hydroxo-carboxylic acids, especially citric acid, as sequestering or chelating agents. A few, but increasingly important, petroleum crude feedstocks and residua contain levels of iron which render them difficult, if not impossible, to process using conventional refining techniques. Specifically, the iron contaminant causing particular problems solved by this invention is in the form of non-porphyrin, organometallically-bound compounds. These species have been attributed to either naturally-occurring iron complexes or solubilized iron from corrosion and decay of iron bearing equipment which comes in contact with crude oils. One possible class of iron-containing compounds identified in particular is the iron naphthenates and their homologous series. These organo-iron compounds are not separated from the feedstock by normal desalting processes, and in a conventinnal refining technique they can cause the very rapid deactivation of hydroprocessing catalysts. Examples of feedstocks demonstrating objectionably high levels of iron compounds are those from the San Joaquin Valley in California. Generally, these crudes are contained in a pipeline mixture referred to as San Joaquin Valley crude or residuum.

The problems presented by these forms of iron in petroleum feedstocks and their necessity for removal has been known for some time, but the prior art contains few references specifically to their removal, especially by extraction methods similar to the present invention. Metals removal using organic compounds generally, however, has been addressed in the prior art, specifically for the removal of known metallic contaminants, which are ordinarily found in feedstocks as porphyrins, and other related organometallic compounds. These metal-containing porphyrins include nickel, vanadium, and/or copper.

In U.S. Pat. No. 3,052,627, Lerner, metals-contaminants are removed from crude petroleum feedstocks using a 2-pyrrolidone-alcohol mixture. In U.S. Pat. No. 3,167,500, Payne, metallic contaminants, such as metal-containing porphyrins, are removed from petroleum oils using a condensed polynuclear aromatic compound having a preferred C/H ratio and a molecular weight ordinarily called pitch binders. In U.S. Pat. No. 3,153,623, Eldib et al., selected commercially available organic compounds of high dielectric strength were added to assist in the electrically-directed precipitation of metals with polar organic compounds.

It has now been unexpectedly found that the iron-containing contaminants may be effectively removed from the feedstocks of the present invention by binding the iron compounds using hydroxo-carboxylic acids and their salts.

SUMMARY OF THE INVENTION

The process comprises a method for demetalating hydrocarbonaceous feedstocks, particularly crude petroleum or residua using an aqueous solution of a chelating or sequestering agent. The method is particularly appropriate for removing iron, especially non-porphyrin, organically-bound iron compounds. The preferred metal chelating agents are the hydroxo-carboxylic acids, such as citric acid and salts thereof, in an aqueous solution. In a preferred process, the feedstock to be demetalized is intimately and thoroughly mixed with an aqueous solution of citric acid or its salts. The metals combine with the agent to form a water soluble complex in the aqueous phase. The aqueous phase and the hydrocarbon phase are separated, and the hydrocarbonaceous feedstock is then available for hydroprocessing.

DETAILED DESCRIPTION OF THE INVENTION

Various petroleum crude feedstocks and residua produced from them contain unacceptably high levels of iron-containing contaminants. These organically-bound iron compounds cause distinct processing difficulties in standard hydroprocessing techniques, ordinarily by the rapid deactivation or fouling of the hydroprocessing catalyst. This invention comprises a method for removing those iron-containing contaminants prior to hydroprocessing of the crude or residua by using known chelating or sequestering agents, hydroxo-carboxylic acids or salts thereof.

The invention can be applied to any hydrocarbonaceous feedstock containing an unacceptably high level of iron. These feedstocks can include crude petroleum, especially from particular sources, such as San Joaquin Valley crude from California, more particularly including South Belridge, Huntington Beach, Wilmington, or Kern River or mixtures thereof. Additionally, atmospheric or vacuum residua or solvent deasphalted oils derived from these crudes and residua which are being increasingly hydroprocessed into more usable products, such as gas oils, gasoline, diesel fuel, etc., also have unacceptably high iron levels. It is within the contemplation of the invention that any other hydrocarbonaceous feedstock, such as shale oil, liquefied coal, beneficiated tar sand, etc., which may contain iron contaminants, may also be processed according to this process.

The basic process is relatively simple: The crude or residuum desired to be processed is mixed with an aqueous solution of a hydroxo-carboxylic acid, salts thereof or mixtures thereof, preferably citric acid or salts thereof, and a base for adjusting the pH above 2, and preferably between 5 to 9. The iron is readily-bound or chelated to the acid ion. This iron/hydroxo-carboxylate complex is ionic and is therefore soluble in the aqueous phase of the mixture. The two phases, the aqueous and the crude or hydrocarbonaceous phase, are separated or permitted to separate, and the aqueous solution is removed. The aqueous solution containing the iron contaminant is removed, resulting in an essentially iron-free hydrocarbon feed. This feed can then be handled in the same manner as any other carbonaceous feed, and processed by conventional hydroprocessing techniques. It is contemplated that the physical separation process is ordinarily to be done in a conventional crude oil desalter, which is usually used for desalting petroleum crudes prior to hydroprocessing. The separation may be done by any separation process, however, and may include countercurrent extraction.

It is well known that hydroxo-carboxylic acids have a high affinity for iron and other metal ions. Known as chelating agents, a common example of these hydroxocarboxylic acids is: citric acid—$C_6H_8O_7$; molecular weight 192.12. It is also known as 2-hydroxy-1,2,3-propanetricarboxylic acid, or β-hydroxytricarballylic acid.

Citric acid is a member of a broad class of multidentate chelating ligands which complex or coordinate metal ions. One current use of citric acid is as a sequestering agent to remove trace metals, and it is also commonly used in the food and beverage industry as a acidulation agent and preservative.

Other hydroxo-carboxylic acids which have comparable activity towards iron are, for example, malic acid, tartaric acid, mandelic acid, and lactic acid. These acids all exhibit polyfunctionality like citric acid which partially accounts for their chelation ability towards iron.

Hydroxo-carboxylic acid complexes with iron ions, forming complexes which are very stable and can be easily isolated. These acids and their salts will complex other metal ions in aqueous solution but appear to have little or no effect on the more commonly found, ordinary organometallic metal contaminants in petroleum, such as nickel and vanadium petroporphyrins. They do, however, have a significant effect on calcium, and hydroxo-carboxylic acids and their salts are effective for removing organo-calcium compounds.

The salt forms of citric acid can be generally formed in situ by the addition of most any strong base, and can be isolated in some cases, from the aqueous solution, as crystalline salts. The salts are generally more water soluble, and less acidic than the free acid.

As discussed previously, in order for the iron to bind appropriately to the citric acid, the pH should be above 2, and preferably 5 to 9. One difficulty with the addition of base, however, is the formation of emulsions, which can interfere with effective separation. Therefore the most preferred pH is around 6, especially for naphthenic acid crudes.

The ratio of aqueous citric acid solution to hydrocarbonaceous feed should be optimized, with the determining factor being the separation method. Commercial desalters, for example, ordinarily run at 10% or less aqueous volume. Countercurrent extraction may also be used for separation. Effective separations have been done at 50% or more aqueous volume.

The contact time between the aqueous extraction solution and the hydrocarbonaceous feed is important, and may vary from between a few seconds to about 4 hours. The preferred contact time is from about 10 minutes to 1 hour.

The temperature at which the extraction takes place is also a factor in process efficiency. Low iron removal is found at room temperature. Moderate to high iron removal is found at elevated temperatures, for example, 180° F. and above. A preferred temperature is about 300° F. and above.

EXAMPLES

In laboratory trials—the results of which are detailed in the tables below—the amount of San Joaquin Valley vacuum residuum (51 ppm Fe) was dissolved in toluene to give a workable viscosity, and was mixed with a 10% to 50% aqueous volume of the citric acid solution. The solution was prepared by dissolving the appropriate amount of the citric acid in deionized $H_2O$ to give the specific mole equivalents of agent to moles of iron, and the pH was adjusted to 6 with ammonium hydroxide. A demulsifier, named treatolite L-1562, was also added. The citric acid solution and the oil mixture was shaken or mixed and allowed to separate, preferably overnight. The residuum was analyzed before and after treatment to determine the amount of iron removed.

EXAMPLE 1

Table I indicates elevated temperatures are necessary for very high iron removal on the order of 73%. At lower temperatures, however, moderate iron removal is still achieved by the citric acid solution.

EXAMPLE 2

Table II indicates long contact times are necessary for very high iron removal on the order of 73%, even when high temperatures are used. At shorter contact times, however, moderate iron removal is still achieved by the citric acid solution.

EXAMPLE 3

Table III indicates mole equivalents dependency for iron removal. Although not dramatic, citric acid does exhibit some mole equivalent dependence for iron removal at elevated temperatures.

EXAMPLE 4

For comparative purposes, Table IV lists iron removal from San Joaquin Valley vacuum residuum by conventional desalting solutions. Little iron removal activity is afforded by these agents, as compared with the Examples above.

TABLE I

IRON REMOVAL FROM SAN JOAQUIN VALLEY VACUUM RESIDUUM WITH CITRIC TEMPERATURE DEPENDENCE (pH 6)

| Temperature, °F. | Mole Citric / Mole Iron | Aqueous Vol, % | Mix Time | % Fe Removal |
|---|---|---|---|---|
| 70 | 30 | 50 | 1 min | 30 |
| 180 | 8 | 50 | 15 min | 47 |
| 300 | 8 | 50 | 60 min | 73 |

TABLE II

IRON REMOVAL FROM SAN JOAQUIN VALLEY VACUUM RESIDUUM WITH CITRIC ACID MIXING TIME DEPENDENCE (pH 6)

| Time | Temperature | Mole Citric / Mole Iron | Aqueous Vol, % | % Fe Removal |
|---|---|---|---|---|
| 15 min | 300° F. | 8 | 50 | 53 |
| 30 min | 300° F. | 8 | 50 | 50 |
| 60 min | 300° F. | 8 | 50 | 73 |

TABLE III

IRON REMOVAL FROM SAN JOAQUIN VALLEY VACUUM RESIDUUM WITH CITRIC ACID MOLE EQUIVALENT DEPENDENCE

| Mole Citric / Mole Iron | % Fe Removal |
|---|---|
| 4 | 43 |
| 8 | 53 |
| 12 | 51 |
| 23 | 59 |

300 ° F., 15 minute reaction time, 50% Aqueous Volume, pH 6

TABLE IV

IRON REMOVAL FROM SAN JOAQUIN VALLEY VACUUM RESIDUUM WITH CONVENTIONAL DESALTING AGENTS

| Agent | Mole Agent Mole Iron | Aqueous Vol, % | Iron Removal, % |
|---|---|---|---|
| Hydrochloric Acid | 6,650 | 66 | 30 |
| Ammonium Hydroxide | large excess | 66 | 12 |
| Water | 200,000 | 16 | 15 |

What is claimed is:

1. An aqueous extraction method for demetalizing Group VIII metals from hydrocarbonaceous feedstock, said process comprising:

mixing said hydrocarbonaceous feedstock with an aqueous solution of a metals sequestering agent comprising hydroxocarboxylic acids, salts thereof, or mixtures thereof; and separating the substantially demetalated hydrocarbonaceous feedstock from the aqueous solution; wherein the feedstock to be demetalated is selected from the group consisting of crude petroleum, atmospheric or vacuum residua, solvent deasphalted oil derived from these crudes or residua, shale oil, liquefied coal, and tar sand effluent.

2. The method as claimed in claim 1 wherein the metal is iron.

3. The method as claimed in claim 1 wherein the metals are organometallically-bound, non-porphyrin compounds.

4. The method as claimed in claim 3 wherein the compounds are compounds of iron.

5. The method as claimed in claim 1, or 3 wherein said hydroxo-carboxylic acids are selected from the group consisting of citric acid, malic acid, tartaric acid, mandelic acid, and lactic acid.

6. The method as claimed in claim 5 wherein said hydroxo-carboxylic acid comprises citric acid.

7. The method as claimed in claim 5 wherein the pH of the mixing step is adjusted to 2 or above.

8. The method as claimed in claim 5 wherein the pH of the mixing step is adjusted to 5 or above.

9. The method as claimed in claim 5 wherein the mixing temperature is about 180° F. or above.

10. The method as claimed in claim 5 wherein the mixing temperature is about 300° F.

11. The method as claimed in claim 5 wherein the mixing time is 10 minutes or more.

12. The method as claimed in claim 5 wherein the mixing time is 1 hour.

13. The method as claimed in claim 1 where said separating is performed by a conventional crude oil desalting process or countercurrent extraction.

* * * * *